US007644485B2

(12) United States Patent
Muller et al.

(10) Patent No.: US 7,644,485 B2
(45) Date of Patent: Jan. 12, 2010

(54) TOOL FOR CONNECTING CABLE CONDUCTORS

(75) Inventors: Manfred Muller, Berlin (DE); Heiko Neumetzler, Berlin (DE)

(73) Assignee: ADC GmbH, Berlin (DE)

( * ) Notice: Subject to any disclaimer, the term of this patent is extended or adjusted under 35 U.S.C. 154(b) by 0 days.

(21) Appl. No.: 11/718,747

(22) PCT Filed: Oct. 31, 2005

(86) PCT No.: PCT/EP2005/011638

§ 371 (c)(1),
(2), (4) Date: May 7, 2007

(87) PCT Pub. No.: WO2006/053633

PCT Pub. Date: May 26, 2006

(65) Prior Publication Data

US 2008/0098586 A1 May 1, 2008

(30) Foreign Application Priority Data

Nov. 17, 2004 (DE) ..... 10 2004 055 386

(51) Int. Cl.
*H01R 43/042* (2006.01)

(52) U.S. Cl. ..... 29/566.4; 29/33 M; 29/751

(58) Field of Classification Search ..... 29/566.1, 29/566.3, 566.4, 751, 758, 861, 866, 33 M; 71/107; 7/107; *H01R 43/42, 43/45; B23P 23/00*
See application file for complete search history.

(56) References Cited

U.S. PATENT DOCUMENTS 3,393,438 A * 7/1968 Marley et al. ..... 29/566.4
3,946,476 A * 3/1976 Mason ..... 29/566.4
3,962,901 A * 6/1976 Anderson et al. ..... 72/325
4,099,316 A * 7/1978 Morgan et al. ..... 29/566.2
4,387,501 A * 6/1983 Rix ..... 29/566.4
4,434,542 A 3/1984 Forberg et al.
4,467,516 A * 8/1984 John et al. ..... 29/566.4
4,567,639 A * 2/1986 Fasano ..... 29/566.4
4,627,150 A * 12/1986 Burnett ..... 29/566.4
4,642,874 A 2/1987 Litehizer, Jr.
4,831,727 A 5/1989 Johnson, Jr. et al.
5,737,823 A * 4/1998 Walker ..... 29/566.4
5,758,403 A 6/1998 Fallandy
5,832,603 A * 11/1998 Fallandy ..... 29/861
6,176,732 B1 1/2001 Schultz et al.
6,704,992 B2 * 3/2004 Minor ..... 29/566.4
6,807,719 B2 * 10/2004 Herr et al. ..... 29/564.6

(Continued)

FOREIGN PATENT DOCUMENTS

AU 613146 8/1989

(Continued)

*Primary Examiner*—Eric A Gates
(74) *Attorney, Agent, or Firm*—Merchant & Gould P.C.

(57) ABSTRACT

The invention relates to a tool for connecting cable cores, in particular of insulated telecommunication and data cables, to an insulation-piercing contact element, with a ram, which is formed with a ram head, by means of which the cable cores can be pressed into the insulation-piercing contact, the ram head being shaped in such a way that at least two cable cores can be pressed in simultaneously into at least two insulation-piercing contact elements lying next to each other.

18 Claims, 4 Drawing Sheets

U.S. PATENT DOCUMENTS

| | | | | |
|---|---|---|---|---|
| 7,073,245 | B2 * | 7/2006 | Alexander et al. | 29/566.4 |
| 2003/0115737 | A1 * | 6/2003 | Minor | 29/566.4 |
| 2004/0010905 | A1 | 1/2004 | Denter et al. | |

FOREIGN PATENT DOCUMENTS

| | | | |
|---|---|---|---|
| DE | 34 32 028 | A1 | 3/1985 |
| DE | 689 15 183 | T2 | 12/1994 |
| DE | 200 18 103 | U1 | 2/2001 |
| EP | 0 040 307 | A1 | 11/1981 |
| EP | 0 329 917 | A1 | 8/1989 |
| GB | 1 288 342 | | 9/1972 |
| TW | 449161 | | 8/2001 |

* cited by examiner 14
15
17
17
32
33
13
25
2
44
10
20
24
7
4
29
19
5
8
18
11
11
22

TOOL FOR CONNECTING CABLE CONDUCTORS

TECHNICAL FIELD

The invention relates to a tool for connecting cable cores, in particular of insulated telecommunication and data cables, to an insulation-piercing contact element.

BACKGROUND

EP 0040307 B1 discloses a tool for connecting insulated electrical conductor wires. This tool comprises a hollow two-shell grip, in which a striking mechanism with a spring-loaded hollow slider and a ram which can be longitudinally displaced against spring force are arranged. Arranged on the part of the ram protruding out of the front end of the grip, on the head of the ram, is a wire cutter comprising two scissor legs, one of the scissor legs being pivotably movable and having at the rear end, located in the interior of the grip, an inclined longitudinal slot, in which a pin fastened in the grip is guided. A longitudinal displacement of the ram consequently leads to a pivoting movement of the movable scissor leg. For connecting an insulated cable core into an insulation-piercing contact arranged in a terminal strip, the ram head is first placed on the terminal strip. Then the grip is manually pressed in the direction of the terminal strip, until the cable core is pressed into the contact slot of the insulation-piercing contact. The advancing force exerted on the grip brings about a relative movement between the ram and the grip and also between the scissor leg of the wire cutter and the pin fastened to the grip, which then slides into the inclined longitudinal slot and thereby pivots the movable scissor leg in such a way that the cutting edge formed on its front end cuts off the cable core.

EP 0329917 B1 also discloses a tool for connecting cable cores to insulation-piercing contacts, with a ram which is longitudinally displaceable in the tool housing and with a cutter for the cable cores, which is arranged on the ram head, the longitudinal displacement of the ram serving for triggering the cutter. Also arranged on the ram is a latching lock, which blocks the longitudinal displacement of the ram with respect to the housing, and arranged on the ram head is a sensor, which is connected to the latching lock and only releases the longitudinal displacement of the ram in the tool housing, and consequently the cutting-off operation, when there is actuation by the insulation-piercing contact or a component surrounding it.

A disadvantage of the tools known from the prior art is that satisfactory handling of the respective tool by the installation engineer is either not possible or else significantly restricted in the case of confined space conditions during the installation operation. In particular when organizing generally bifilar telecommunication and data lines on an already occupied terminal strip, difficulties frequently occur if—as is generally usual—the already occupied insulation-piercing contact elements of a terminal strip are provided with safety connectors, in order to ensure overvoltage protection, for example against lightning strikes. As a result, the space conditions at an insulation-piercing contact element to be newly occupied are restricted by the spatial extent of the surrounding safety connectors alone, which has the effect on the one hand that the line to be organized can no longer be positioned correctly at the contact slot of the insulation-piercing contact element before the actual connecting and pressing-in operation and on the other hand that the connecting tool required for the installation can no longer be brought close enough to the insulation-piercing contact element that is to be newly occupied to press the line in and cut it off. The only solution remaining for the installation engineer is often to pull off all those surrounding safety connectors that are hindering the installation operation, to make it possible in the first place for the line that is to be organized to be connected. However, on the one hand this means additional work for the installation engineer and on the other hand also does not correspond to the desirable procedure from safety aspects. Moreover, re-fitting of the safety connectors may be forgotten. Optimizing a tool for connecting cable cores to an insulation-piercing contact element when there are reduced space conditions on the terminal strip consequently represents a problem which has so far not been solved satisfactorily by the customary methods and devices that are known from the prior art.

SUMMARY

The invention is therefore based on the technical problem of providing an improved tool for connecting cable cores to an insulation-piercing contact element.

The invention is based here on the recognition that on the one hand simultaneous connection of two cable cores of a bifilar line to two insulation-piercing contact elements lying next to each other in a single working step offers the possibility of better utilizing the installation space that is available, and consequently being able to dispense with pulling out the surrounding safety connectors, if a specially configured tool is used. On the other hand, temporary fixing of the cable cores to be connected to the ram head of the tool before the actual connecting and pressing-in operation facilitates the reliable pre-positioning of the cable cores. This is achieved according to the invention by proposing a connecting tool in which the ram head is shaped in such a way that at least two cable cores can be connected and pressed in at least two insulation-piercing contact elements lying next to each other. This also allows quick, positionally accurate and reliable connecting of cable cores even when there are very confined space conditions on the terminal strip, which are caused for example by safety connectors attached to the surrounding insulation-piercing contact elements, without having to pull further safety connectors out of the terminal strip for installation purposes apart from the safety connector provided for the double core that is to be installed.

In a preferred embodiment, the ram protrudes through an opening in an end face of a tool housing, in which the ram is arranged in a longitudinally displaceable manner. Arranged on the ram head is a cutter for the cable cores, the longitudinal displacement of the ram serving for triggering the cutting-off operation. As a result, connecting, pressing-in and cutting-off take place in one operation, the defined cutting-off of the cable cores allowing the transmission properties at the contacts to be reproduced in terms of quality.

In an advantageous embodiment, the part of the ram protruding from the tool comprises a ram head and a ram shank. In this case, the ram head primarily serves for attaching the subcomponents of the tool that are required for the connecting, pressing-in and cutting-off of the cable cores and are in direct engagement with the insulation-piercing contact element during the installation operation. The function of the ram shank, on the other hand, is mainly based on the idea of producing an operative connection between the mechanical subcomponents accommodated in the tool housing and the subcomponents attached to the ram head and also of increasing the range of the tool by its length. The ram head preferably differs here from the ram shank by a greater extent in the circumferential direction. In the case of those embodiments in which the cutter is formed by two scissor blades which are movable with respect to each other and are pivotally mounted with respect to each other about a common axis, the ram is divided into the ram head and the ram shank precisely by that vertical plane which runs perpendicularly in relation to the longitudinal direction of the tool and includes the pivot axis of the cutter.

In a further advantageous embodiment, the cutter arranged on the ram head comprises two scissor blades which are movable with respect to each other, one of the two scissor blades having at least one shearing surface and the other scissor blade having at least two shearing surfaces. In this case, the at least two shearing surfaces located on one scissor blade are provided for the purpose of respectively shearing off simultaneously and separately from one another one of the cable cores that are to be connected to an insulation-piercing contact element and cut off.

In a further advantageous embodiment, at least one of the shearing surfaces is part of a u-shaped indentation of one of the scissor blades. This u-shaped indentation serves the purpose of enclosing the cable cores that are to be cut and avoiding slipping away or escaping of the cable core during the cutting-off operation.

In a further preferred embodiment, at least one of the shearing surfaces has a beveled cutting-edge geometry. Such a shearing surface, configured for example in the form of a beveled edge (chamfer), offers the advantage of an optimum shearing action in combination with the opposite shearing blade during the cutting-off of the cable core.

In a further embodiment, the scissor blades are arranged lying flat on the ram, one over the other, an inner scissor blade being arranged between the ram and an outer scissor blade and the outer scissor blade not being in contact, by at least one of its outer surfaces, either with the ram head and/or ram shank or with the other scissor blade. An embodiment of this type, in which the cutter is attached to a certain extent such that it lies freely on the ram and the outer scissor blade is not restricted by the geometry of the ram, makes particularly simple assembly of the tool possible and similarly, if need be, uncomplicated exchange of one of the scissor blades.

In a further embodiment, the outer scissor blade has a u-shaped indentation and two shearing surfaces with beveled cutting-edge geometry, the one shearing surface being part of the u-shaped indentation and the other shearing surface being formed by part of the narrow outer surface of the scissor blade running in the longitudinal direction. In this case, the u-shaped indentation serves the purpose of enclosing one of the cable cores that is to be cut and avoiding slipping away or escaping of the cable core during the cutting-off operation, while the beveled cutting-edge geometry, for example in the form of a beveled edge (chamfer), ensures an optimum shearing action in combination with the opposite shearing blade during the cutting-off of the cable cores.

In a further advantageous embodiment, the inner scissor blade has two u-shaped indentations and two shearing surfaces, the two shearing surfaces respectively being part of one of the two u-shaped indentations. In this case, the distances between the u-shaped indentations preferably correspond to the spacing pitch of the insulation-piercing contact elements in the terminal strip to which the cable cores are to be connected. The u-shaped indentations, and in particular the two shearing surfaces, in this case respectively form a complementary cutting edge with respect to the shearing surface of the outer scissor blade and in this way permit secure enclosing of the cable cores that are to be cut and an optimum shearing action. In this case, the cutting-edge regions of the inner scissor blade preferably correspond to the opposite cutting-edge regions of the outer scissor blade and preferably cover one another completely, or at least partly, in the course of their shearing movement with respect to each other.

In a further preferred embodiment, the outer scissor blade is movable and pivotable with respect to the inner scissor blade. In this case, the inner scissor blade is fixed, while the outer scissor blade can perform a pivoting movement with respect to the inner scissor blade, it preferably being possible for the pivoting movement to be triggered by means of an inclined groove with the aid of a spring-loaded slider in the tool housing. This embodiment allows a particularly simple, low-cost, stable and low-maintenance construction of the connecting tool.

In a further preferred embodiment, the scissor blades are mounted pivotably with respect to each other about a common axis. On account of the lever action produced during the shearing operation, depending on the arrangement of the pivot point, this allows a particularly favorable ratio of forces between the manual force applied by the installation engineer and the shearing forces acting, which can in this way be made to suit exactly the thickness of the wire to be cut off with the tool.

In a further preferred embodiment, the common axis is formed by a connecting element which connects the two scissor blades pivotably to each other and to the ram. As a result, a particularly simple and stable construction of the tool is ensured.

In a further preferred embodiment, the connecting element is formed as a screw. This allows a particularly simple and stable construction of the tool and, if need be, uncomplicated exchange of the scissor blades. In principle, apart from this preferred configuration, however, other fastening means are also conceivable as the connecting element, such as rivets for example.

In a further preferred embodiment, the ram shank is at least just as long as the ram head. A ram shank which is of the same length as the ram head or longer in this case serves the purpose of increasing the range of the tool. In particular when bifilar lines are being connected simultaneously to two insulation-piercing contact elements lying next to each other of a terminal strip, there are particularly confined space conditions on the terminal strip if the neighboring insulation-piercing contact elements are all fitted with safety connectors. In this case, an extension of the ram shank can be deliberately used to increase the distance between the safety connector and the tool housing in particular, which otherwise often proves to be a problem during the installation operation. This has the consequence that, even if the intermediate space between two surrounding safety connectors is just narrow enough to allow the ram of the tool to pass through, satisfactory connecting and pressing-in of the cable cores in the terminal strip is nevertheless possible with the aid of the connecting tool and there is no collision between the tool housing and safety connectors during the installation operation.

In a further preferred embodiment, a latching lock which blocks the longitudinal displacement of the ram with respect to the tool housing is arranged on the ram, and a sensor which is connected to the latching lock and releases the latching lock when there is actuation by a terminal strip which comprises the insulation-piercing contact elements is arranged on the ram head. In this case, the sensor which is arranged on the ram head and is connected to the latching lock only releases the longitudinal displacement when the cable core that is to be connected has fully reached the end position in the contact slot of the insulation-piercing contact element and a satisfactory connection has been established. This ensures that the end of the cable core is only cut off after contacting has taken place. It is in this case also conceivable that the latching lock can be manually unlocked independently of the sensor by means of an unlocking device, for example for the case in which two cable cores are to be connected into the same contact slot of an insulation-piercing contact element.

In a further preferred embodiment, the sensor acts via a sensor rod on a spring-loaded pawl of the latching lock. This corresponds to a particularly simple, stable and maintenance-free type of construction of the tool. In this case, when a reference point, which may be formed for example by part of the terminal strip, is reached, a mechanically acting sensor exerts a force via a sensor rod on the spring-loaded pawl of the latching lock, in this way signals the correct pressing-in depth of the cable cores into the contact slot of the insulation-piercing contact element and only then releases the cutting movement for cutting off the ends of the cable cores.

In a further preferred embodiment, the sensor rod runs at least partly in the ram head in a vertical plane running centrally through the tool and at least partly in the ram shank in a plane parallel to the vertical plane running centrally through the tool. This arrangement is of advantage in particular in the case of embodiments with scissor blades which are mounted pivotably about an axis with respect to each other, if the sensor is attached centrally in the ram head and the force is then likewise passed on substantially centrally in the longitudinal direction from the sensor via the sensor rod in the ram head. In order to avoid space problems within the ram in the case of this configuration, the sensor rod is then preferably angled away a number of times and is continued within the ram shank slightly offset laterally with respect to the vertical central plane of the tool, so that no conflict occurs with the arrangement of the pivot axis of the scissor blades, or the corresponding connecting element.

In a further preferred embodiment, at least two pressing-in plates are arranged parallel to each other in the ram head. These plates may be produced for example from metal and offer the advantage of particularly high stability, so that satisfactory functioning of the tool is always ensured even when there are great pressing-in forces and the tool is used frequently. Although the pressing-in plates are preferably configured as components which are separately attached in the ram head, it is also conceivable that the pressing-in plates can be formed from a single part together with the ram head.

In a further preferred embodiment, the end face of the ram head is provided with a longitudinally slit clamping element for receiving at least two cable cores. This allows the cable cores to be temporarily fixed to the ram head before the actual connecting and pressing-in operation, whereby particularly safe handling and more accurate pre-positioning of the cable cores at the contact slot of the insulation-piercing contact element is made possible, in particular when there are confined space conditions on the terminal strip. In this case, the means for fixing the cable cores in the clamping element are preferably configured as parallel slots, which are made slightly wider than the diameter of the cable cores to be connected. In order to ensure the fixing of the cable cores, detents are in this case preferably attached to the slot openings, which are open toward the end face of the clamping element and allow the cable cores to latch in the clamping element before the actual connecting and pressing-in operation at the contact slot of the insulation-piercing contact element. The opening left free by the detents on the end face of the clamping element is in this case just large enough that, after connecting, pressing-in and cutting-off of the cable cores has taken place in the terminal strip, the clamping forces of the insulation-piercing contact element acting on the respective cable core are greater than the clamping forces of the longitudinally slit clamping element on the ram head. This has the effect that, when the tool is withdrawn, the cable cores can be released again from the longitudinally slit clamping element and remain in the insulation-piercing contact element. The longitudinally slit clamping element preferably has a certain resilience in this case, in particular at its lateral longitudinal webs, and is made for example from plastic. The central piece of the clamping element located between the longitudinal slots is preferably configured as an extended central web, which protrudes in the longitudinal direction slightly beyond the openings of the longitudinal slots and is beveled slightly on both sides. This allows facilitated guidance of the tool and also reliable positioning of the ram head in the terminal strip in the optimum position for the connecting and pressing-in operation.

In a further preferred embodiment, the clamping element is formed as a separate element and is connected to the ram head. This allows particularly simple production of the tool. Furthermore, in this way it is also possible, depending on the thickness of the wire of the cable cores that are to be connected, for different clamping elements to be used on one tool. In this case, the clamping element is preferably configured as a screwed-on plate made of plastic, which is inserted in a recess of the ram head and finishes flush with the underside of the ram head. However, alternative embodiments in which the clamping element is formed from a single part together with the ram head are also conceivable.

In a further preferred embodiment, a swinging-out pulling hook and/or a piercing tool are attached in the tool housing. These can be swung out of their position of rest in the tool housing laterally from corresponding side slots in the tool housing into their operating position. With the pulling hook, already connected cable cores can be pulled out again from the contact slot of the insulation-piercing contact element. With the piercing tool it is possible for example to release latching connections between the terminal strip and its holder, for example by engaging behind formed-on lugs.

In an alternative embodiment there is proposed a connecting tool which, in a way similar to the tool previously known from EP 0329917 B1, has a ram which is longitudinally displaceable in the tool housing and protrudes through an opening in the end face of the tool housing, and which also has a cutter arranged on the ram head for cutting off cable cores, the longitudinal displacement of the ram serving for triggering the cutting-off operation. As a difference from the device known from EP 0329917 B1, however, in the case of the proposed connecting tool the ram head is shaped in such a way that the end face of the ram head is provided with a longitudinally slit clamping element for receiving at least one cable core. This allows the cable core to be temporarily fixed to the ram head before the actual connecting and pressing-in operation, whereby particularly safe handling and more accurate pre-positioning of the cable core at the contact slot of the insulation-piercing contact element is made possible. This allows quick, positionally accurate and reliable connecting of cable cores. In this case, the means for fixing the cable core in the clamping element is preferably configured as a slot, which is made slightly wider than the diameter of the cable core to be connected. In order to ensure the fixing of the cable cores, a detent is in this case preferably attached to the slot opening, which is open toward the end face of the clamping element and allows the cable core to latch in the clamping element before the actual connecting and pressing-in operation at the contact slot of the insulation-piercing contact element. The opening left free by the detent on the end face of the clamping element is in this case just large enough that, after connecting, pressing-in and cutting-off of the cable core has taken place in the terminal strip, the clamping forces of the insulation-piercing contact element acting on the cable core are greater than the clamping forces of the longitudinally slit clamping element on the ram head. This has the effect that, when the tool is withdrawn, the cable core can be released again from the longitudinally slit clamping element and remains in the insulation-piercing contact element. The longitudinally slit clamping element preferably has a certain resilience in this case, in particular at its lateral longitudinal webs, and is made for example from plastic. The clamping element is preferably formed as a separate element and is connected to the ram head. This allows particularly simple production of the tool. Furthermore, in this way it is also possible, depending on the thickness of the wire of the cable core that is to be connected, for different clamping elements to be used on one tool. In this case, the clamping element is preferably configured as a screwed-on plate made of plastic, which is inserted in a recess of the ram head and finishes flush with the underside of the ram head. However, alternative embodiments in which the clamping element is formed from a single part together with the ram head are also conceivable. Otherwise, this alternative embodiment is based on the tool described more precisely in EP 0329917 B1, so that reference is made to the comments made there in their entirety.

BRIEF DESCRIPTION OF THE DRAWINGS

The invention is explained in more detail below on the basis of a preferred exemplary embodiment. In the associated drawings.

DETAILED DESCRIPTION

Figure 1:
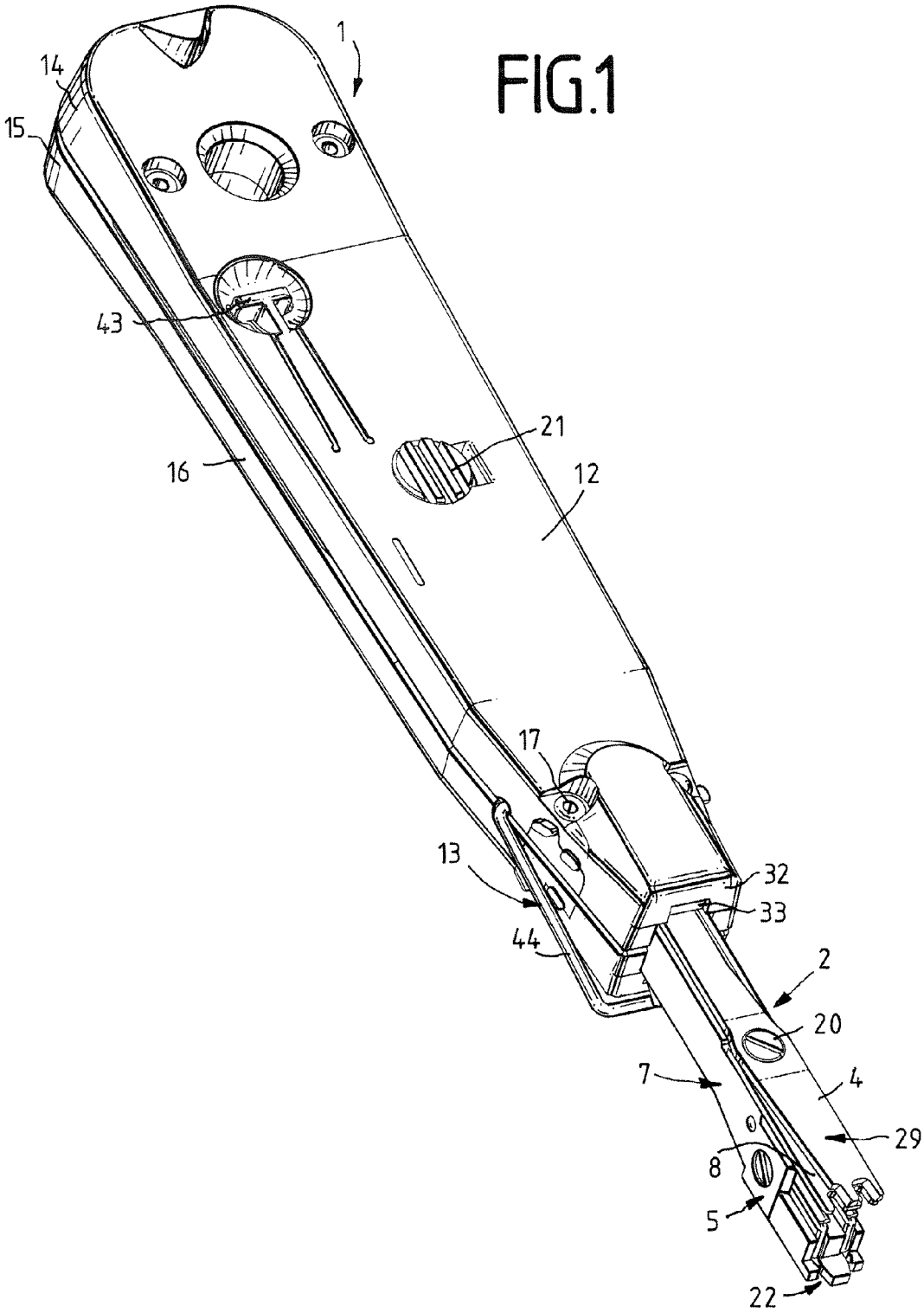
FIG. 1 shows an oblique view of the tool in a three-dimensional representation.

FIG. 1 shows a tool 1, which comprises a tool housing 12 which is formed by two plastic half-shells 14, 15 and forms a grip 16. The two housing half-shells 14, 15 are connected against each other by means of screws 17. Arranged in the grip 16, which is provided with an opening 33 at one end face 32, is a longitudinally displaceable ram 2, which is provided with a striking mechanism and protrudes through the opening 33 in the end face 32 of the tool housing 12. The part of the ram 2 protruding from the tool 1 comprises a ram head 5, located at the front end of the ram 2, and a ram shank 7, located between the ram head 5 and the opening 33 of the tool housing. Arranged on the ram head is a cutter 29 for cutting off cable cores, the longitudinal displacement of the ram 2 serving for triggering the cutting-off operation. The cutter 29 in this case comprises two scissor blades 4, 8, which are movable with respect to each other and are arranged lying flat on the ram head 5, one over the other, an inner scissor blade 8 being arranged between the ram 2 and an outer scissor blade 4. In this case, the inner scissor blade 8 is fixed, while the outer scissor blade 4 can perform a pivoting movement with respect to the inner scissor blade 8, it being possible for the pivoting movement to be triggered by means of an inclined groove and the pin 42 sliding in the inclined groove with the aid of a spring-loaded slider in the tool housing 12. The scissor blades 4 and 8 are mounted pivotably with respect to each other about a common axis. The common axis is formed by a screw 20, which connects the two scissor blades 4, 8 pivotably to each other and also to the ram 2. The outer scissor blade 4 is not in contact, either by its upper outer surface or by its two narrow outer surfaces running in the longitudinal direction of the tool 1, either with the ram head 5 or with the ram shank 7. The cutter 29 is therefore attached to a certain extent such that it lies freely on the ram 2 and movement of the outer scissor blade 4 is not restricted by the geometry of the ram 2. In addition, a rotary knob 21 is provided as a fixing means in the grip 16 and a latching lock 3 is arranged between two side walls 24, 25 of the ram 2. The latching lock 3 comprises a spring-loaded pawl 10, which is pivotably arranged in the ram 2. The pawl 10 assumes a defined position under spring loading, in which part of the pawl 10 that is formed in the shape of a hook engages behind the end wall 34 of the housing half-shell 15. Such a tool with a ram, slider, cutter, rotary knob and latching lock is described more precisely in EP 0329917 B1, to which reference is expressly made. As a difference from the tool known from EP 0329917 B1, however, in the tool 1 the ram head 5 and cutter 29 are shaped in such a way that two cable cores can be introduced simultaneously into two insulation-piercing contact elements lying next to each other and the overhanging ends of the wire can be cut off.

Figure 2:
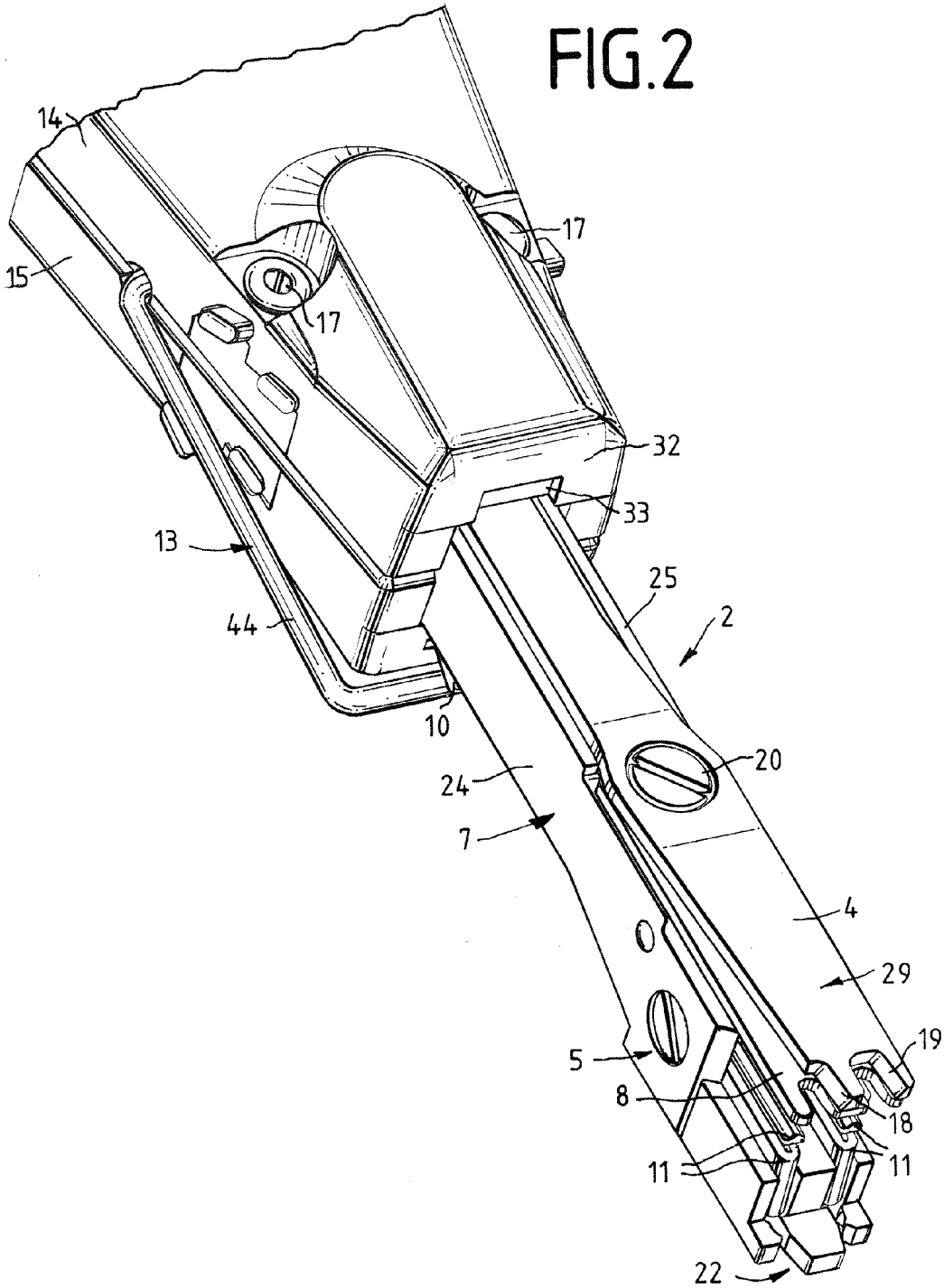
FIG. 2 shows an oblique view of the front part of the tool in a three-dimensional representation.

In this case, as shown in FIG. 2, the outer scissor blade 4 has a u-shaped indentation and two shearing surfaces 18, 19 with beveled cutting-edge geometry in the form of a beveled edge (chamfer), the one shearing surface 19 being part of the u-shaped indentation and the other shearing surface 18 being formed by part of the narrow outer surface of the scissor blade 4 running in the longitudinal direction. Furthermore, the inner scissor blade 8 has two u-shaped indentations and two shearing surfaces, the two shearing surfaces respectively being part of one of the two u-shaped indentations. In this case, the distances between the u-shaped indentations correspond to the spacing pitch of the insulation-piercing contact elements in the terminal strip to which the cable cores are to be connected. The u-shaped indentations, and in particular the two shearing surfaces, in this case respectively form a complementary cutting edge with respect to the shearing surfaces 18, 19 of the outer scissor blade 4. In this case, the cutting-edge regions of the inner scissor blade 8 preferably correspond to the opposite cutting-edge regions of the outer scissor blade 4 and cover one another completely in the course of their shearing movement with respect to each other. The ram 2 of the tool 1 is divided into the ram head 5 and the ram shank 7 precisely by that vertical plane which runs perpendicularly in relation to the longitudinal direction of the tool 1 and includes the pivot axis of the cutter 29, i.e. the screw 20. In this case, the ram shank 7 is somewhat longer than the ram head 5, in order to increase the range of the tool 1.

Figures 3, 4:
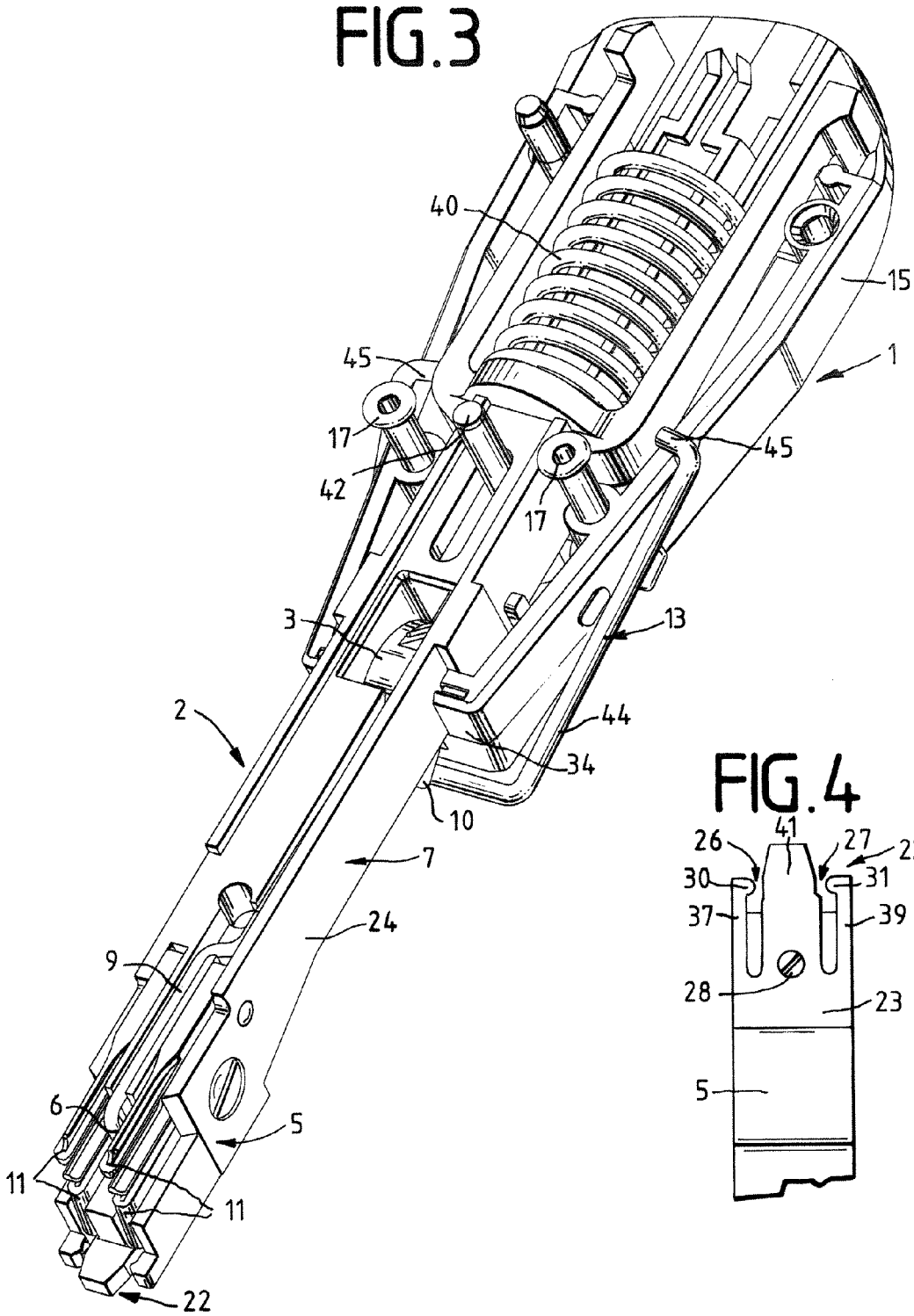
FIG. 3 shows an oblique view of the opened tool in a three-dimensional representation without the cutter and the upper half-shell of the tool housing.
FIG. 4 shows a schematic representation of the clamping element attached to the ram head, in a view from below.

Additionally arranged on the ram 2 is a latching lock 3, which blocks the longitudinal displacement of the ram 2 with respect to the housing 12, as shown more clearly in FIG. 3. Arranged on the ram head 5 is a sensor 6, which is connected to the latching lock 3 and releases the latching lock 3 when there is actuation by a terminal strip which comprises the insulation-piercing contact elements. In this case, the sensor 6 which is arranged on the ram head 5 and is connected to the latching lock 3 only releases the longitudinal displacement when the cable core that is to be connected has fully reached the end position in the contact slot of the insulation-piercing contact element and a satisfactory connection has been established. Hooked into the spring-loaded pawl 10 is a sensor rod 9, which is led through the ram 2 up to the front part of the ram head 5 and is formed there as a sensor 6 by being bent down by 90°. The sensor 6 is in this case mounted between two pressing-in plates 11 which are made of metal, are arranged parallel to each other in the ram head 5 and are configured as components which are separately fitted in the ram head 5. In order to avoid a collision of the sensor rod 9 within the ram 2 with the screw 20, the sensor rod 9 is then angled away twice in the region of the screw 20 and then continued within the ram shank 7 slightly offset laterally with respect to the vertical central plane of the tool 1, so that no conflict occurs with the arrangement of the pivot axis of the scissor blades 4, 8. The sensor rod 9 consequently runs in the ram head 5 in a vertical plane running centrally through the tool 1 and in the ram shank 7 in a plane parallel to the vertical plane running centrally through the tool. When a reference point, which may be formed for example by part of the terminal strip, is reached, the mechanically acting sensor 6 exerts a force via the sensor rod 9 on the spring-loaded pawl 10 of the latching lock 3, in this way signals the correct pressing-in depth of the cable cores into the contact slot of the insulation-piercing contact element and only then releases the cutting movement for cutting off the ends of the cable cores. The pawl 10 of the latching lock 3 can also be manually unlocked independently of the sensor 6 by means of an unlocking device 13, for example for the case in which two cable cores are to be connected into the same contact slot of an insulation-piercing contact element. For this purpose, a u-shaped wire clip 44 is fastened by its two leg ends 45 onto the outside of the housing half-shells 14, 15 of the grip 16 as a locking device 13. By manual pivoting of the wire clip 44, the central part of the wire clip 44 presses against the pawl 10 and consequently pivots the pawl of the latching lock 3 inward, whereby the longitudinal displacement of the ram 2 is released. If, however, the longitudinal displacement is not to be released by the unlocking device 13 or by the sensor 6, the ram 2 can be fixed by turning the rotary knob 21. The function of the rotary knob 21 is explained more precisely in EP 0040307 B1. Furthermore, a swinging-out pulling hook and a piercing tool are attached within the tool housing 12 between the housing half-shells 14, 15 and can be swung out of their position of rest from corresponding side slots in the grip 16 with the aid of a button 43 which is beveled away on its underside.

Furthermore, the end face of the ram head 5 is provided with a longitudinally slit clamping element 22 for receiving two cable cores, as shown more precisely in FIG. 4 in particular, allowing the cable cores to be temporarily fixed to the ram head 5 before the actual connecting and pressing-in operation. In this case, the means for fixing the cable cores in the clamping element 22 are configured as parallel slots 26, 27, which are made slightly wider than the diameter of the cable cores to be connected. In order to ensure the fixing of the cable cores, detents 30, 31 are in this case attached to the slot openings, which are open toward the end face of the clamping element 22 and allow the cable cores to latch in the clamping element 22 before the actual connecting and pressing-in operation. The opening left free by the detents 30, 31 on the end face of the clamping element 22 is in this case just large enough that, after connecting, pressing-in and cutting-off of the cable cores has taken place in the terminal strip, the clamping forces of the insulation-piercing contact element acting on the cable core are greater than the clamping forces of the longitudinally slit clamping element 22 on the ram head 5. This has the effect that, when the tool 1 is withdrawn from the terminal strip, the cable cores that are then successfully connected to the insulation-piercing contact element can be released again from the longitudinally slit clamping element 22 and remain in the insulation-piercing contact element. The longitudinally slit clamping element 22 has a certain resilience in this case, in particular at its lateral longitudinal webs 37, 39, and is made from plastic. The central piece of the clamping element located between the longitudinal slots 26, 27 is configured as an extended central web 41, which protrudes in the longitudinal direction slightly beyond the openings of the longitudinal slots and is beveled slightly on both sides. The clamping element 22 is formed as a separate element in the form of a plastic plate 23 and is connected to the ram head 5 by a screw 28. The plastic plate 23 is in this case inserted in a recess of the ram head 5 and finishes flush with the underside of the ram head 5.

Figure 5:
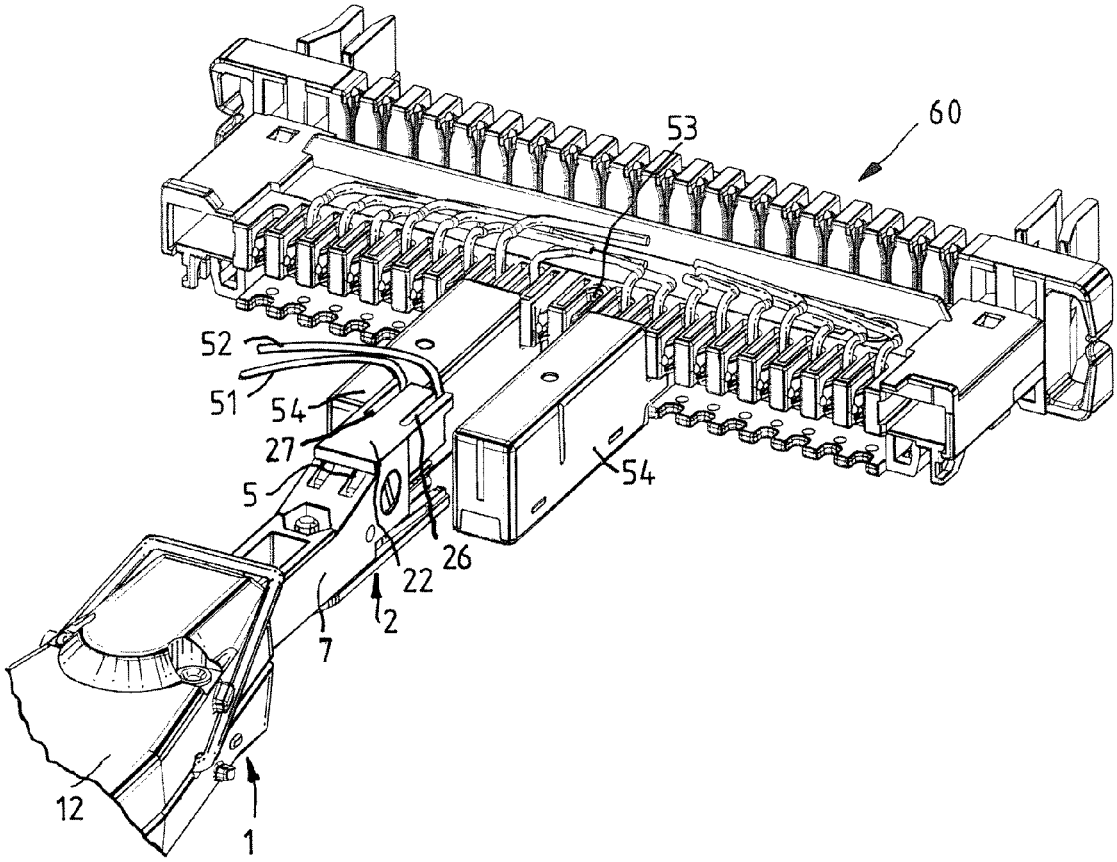
FIG. 5 shows a perspective representation of the tool when connecting two cores.

In FIG. 5, the tool 1 is represented as it is when connecting two cores 51, 52, the two neighboring contacts of the terminal strip 60, to the left and right of the insulation-piercing contacts 53 to be wired, being protected in each case by a safety connector 54. The two cores 51, 52 are in this case inserted in the slots 26, 27 of the clamping element 22, where they are temporarily fixed. The ram head 5 is in this case dimensioned in such a way that it fits between the two safety connectors 54. The length of the ram 2 is in this case long enough that, when part of the ram shank 7 enters the tool housing 12 during the connecting movement, the remaining part of the ram 2 is longer than the overall height of the safety connectors. As a result, the inserted safety connectors 54 do not hinder the connecting operation.

LIST OF DESIGNATIONS

Tool for Connecting Cable Cores

1 tool
2 ram
3 latching lock
4 outer scissor blade
5 ram head
6 sensor
7 ram shank
8 inner scissor blade
9 sensor rod
10 pawl
11 pressing-in plate
12 tool housing
13 unlocking device
14, 15 housing half-shells
16 grip
17 screws
18, 19 shearing surfaces
20 screw
21 rotary knob
22 clamping element
23 plastic plate
24, 25 side walls
26, 27 slots
28 screw
29 cutter
30, 31 detents
32 end face
33 opening
34 end wall
37, 39 longitudinal webs
40 compression spring
41 central web
42 pin
43 button
44 wire clip

45 leg ends
51, 52 cores
53 insulation-piercing contact
54 safety connector
60 terminal strip

The invention claimed is:

1. A tool for connecting cable cores of insulated telecommunication and data cables to insulation-piercing contact elements, comprising:

a ram, which includes a ram head and a ram shank that is configured to press the cable cores into the insulation-piercing contact elements, wherein the ram head is shaped and configured to enable at least two cable cores to be pressed simultaneously into at least two of the insulation-piercing contact elements lying next to each other;

a tool housing having an end face defining an opening through which at least a part of the ram protrudes, wherein the ram is configured to be displaced within the tool housing in a longitudinal direction; and a cutter arranged on the ram head, the cutter being triggered by the longitudinal displacement of the ram within the tool housing, the cutter including an outer scissor blade and an inner scissor blade, at least one of the scissor blades being configured to pivot about an axis extending transversely to the longitudinal displacement of the ram within the tool housing, the outer scissor blade having at least two substantially parallel shearing surfaces facing in a common direction, the inner scissor blade having at least one shearing surface that forms a complementary shearing surface for the outer scissor blade.

2. The tool as claimed in claim 1, wherein at least one of the shearing surfaces is part of a u-shaped indentation of one of the scissor blades.

3. The tool as claimed in claim 1, wherein at least one of the shearing surfaces has a beveled cutting-edge geometry.

4. The tool as claimed in claim 1, wherein the scissor blades are arranged lying flat on the ram, one over the other, the inner scissor blade being arranged between the ram and the outer scissor blade and the outer scissor blade not being in contact, by at least one of its outer surfaces, either with the ram or with the inner scissor blade.

5. The tool as claimed in claim 4, wherein the outer scissor blade has a u-shaped indentation and the two shearing surfaces of the outer scissor blade have beveled cutting-edge geometry, one of the shearing surfaces being part of the u-shaped indentation and the other shearing surface of the outer scissor blade being formed by part of a narrow section of an outer surface of the outer scissor blade, the narrow section extending in the longitudinal direction.

6. The tool as claimed in claim 4, wherein the inner scissor blade has two u-shaped indentations and two shearing surfaces, the two shearing surfaces respectively being part of one of the two u-shaped indentations.

7. The tool as claimed in claim 4, wherein the outer scissor blade is pivotable with respect to the inner scissor blade.

8. The tool as claimed in claim 1, wherein the scissor blades are mounted pivotably with respect to each other about a common axis.

9. The tool as claimed in claim 8, wherein the common axis is formed by a connecting element, which connects the two scissor blades pivotably to each other and to the ram.

10. The tool as claimed in claim 9, wherein the connecting element is formed as a screw.

11. The tool as claimed in claim 8, wherein the ram shank is at least as long as the ram head.

12. The tool as claimed in claim 1, wherein a latching lock which blocks the longitudinal displacement of the ram with respect to a tool housing is arranged on the ram, and a sensor which is connected to the latching lock and releases the latching lock when there is actuation by a terminal strip which comprises the insulation-piercing contact elements is arranged on the ram head.

13. The tool as claimed in claim 12, wherein the sensor acts via a sensor rod on a spring-loaded pawl of the latching lock.

14. The tool as claimed in claim 13, wherein the sensor rod runs at least partly in the ram head in a vertical plane running centrally through the tool and at least partly in the ram shank in a plane parallel to the vertical plane running centrally through the tool.

15. The tool as claimed in claim 1, wherein at least two pressing-in plates are arranged parallel to each other in the ram head.

16. The tool as claimed in claim 1, wherein the end face of the ram head is provided with a longitudinally slit clamping element for receiving at least two cable cores.

17. The tool as claimed in claim 16, wherein the clamping element is formed as a separate element and is connected to the ram head.

18. The tool as claimed in claim 1, wherein a swinging-out pulling hook and/or a piercing tool are attached in the tool housing.

* * * * *